US005919391A

United States Patent [19]

Jun

[11] Patent Number: 5,919,391

[45] Date of Patent: Jul. 6, 1999

[54] MICROWAVE OVEN HAVING ARCUATE CONCAVE PORTIONS IN A CAVITY FOR DISTRIBUTING MICROWAVES

[75] Inventor: Woo-Keum Jun, Seoul, Rep. of Korea

[73] Assignee: Daewoo Electronics Co., Ltd., Seoul, Rep. of Korea

[21] Appl. No.: 09/062,663

[22] Filed: Apr. 20, 1998

[51] Int. Cl.[6] ..... H05B 6/74

[52] U.S. Cl. ..... 219/746; 219/728

[58] Field of Search ..... 219/728, 745, 219/746, 756, 754

[56] References Cited

U.S. PATENT DOCUMENTS

| | | | |
|---|---|---|---|
| 3,661,260 | 5/1972 | Bremer et al. | 219/10.55 |
| 4,771,155 | 9/1988 | Yangas et al. | 219/10.55 F |
| 4,937,418 | 6/1990 | Boulard . | |
| 5,698,128 | 12/1997 | Sakai et al. . | |

FOREIGN PATENT DOCUMENTS

| | | | |
|---|---|---|---|
| 1515156 | 7/1969 | Germany | 219/746 |

*Primary Examiner*—Teresa Walberg
*Assistant Examiner*—Jeffrey Pwu
*Attorney, Agent, or Firm*—Pillsbury Madison & Sutro LLP

[57] ABSTRACT

A microwave oven which can uniformly distribute a microwave in a cooking cavity. The oven has a cabinet having a cooking cavity and a control chamber separated from the cooking cavity, a door installed at a front of the cooking cavity, a magnetron installed at the control chamber for generating a microwave, and a wave guide for guiding the microwave generated by the magnetron into the cooking cavity. The cooking cavity is defined by an upper wall, a bottom wall, a first side wall at which the wave guide is attached, a second side wall positioned opposite to the first side wall, the door, and a third side wall positioned opposite to the door. The first side wall is formed with a microwave outlet. The second and third side walls are formed with at least one arcuate concave portion for distributing the microwave. The oven uniformly penetrates the microwave into foodstuffs in vertical and horizontal directions, thereby effectively heating the foodstuffs.

14 Claims, 7 Drawing Sheets

MICROWAVE OVEN HAVING ARCUATE CONCAVE PORTIONS IN A CAVITY FOR DISTRIBUTING MICROWAVES

BACKGROUND OF THE INVENTION

1. Field of the Invention

The present invention relates to a microwave oven, and more particularly to a microwave oven which can uniformly distribute microwaves in vertical and horizontal directions within a cavity, thereby effectively heating foodstuffs.

2. Prior Arts

As is well known, a microwave oven is an appliance for heating foodstuffs by passing microwaves through the foodstuffs. Generally, the microwave oven has a magnetron which generates the microwaves when a high-voltage is applied thereto. In the microwave oven, the magnetron generates the microwaves having a frequency of approximately 2,450 MHz. When the high frequency microwaves are radiated to the foodstuffs contained in a cooking cavity, particles of the foodstuffs are rapidly moved so that a frictional heat is generated from a friction between the particles. The microwave oven heats the foodstuffs by using the frictional heat.

Such microwaves are generated when a high-voltage produced by primary and secondary induction coils of a transformer disposed at a lower wall of a cabinet is applied to the magnetron, and the microwaves are radiated into the cooking cavity through a wave guide.

FIG. 11 shows a conventional microwave oven 400.

As shown in FIG. 11, conventional microwave oven 400 has a cabinet 430. Cabinet 430 includes a cooking cavity 410 and a control chamber 420 which are separated from each other by a partition 415.

A wave guide 450 which guides high frequency microwaves generated from a magnetron 440 into cooking cavity 410 is attached to a predetermined position on partition 415. Magnetron 440 is coupled to a side of wave guide 450. In order to radiate the high frequency microwaves into cooking cavity 410, an aperture 452 is formed at a predetermined position in partition 415. In addition, an antenna 442 for sending the high frequency microwaves is integrally formed at a side of magnetron 440.

A transformer 460 for generating a high voltage is mounted on a lower wall of control chamber 420. Transformer 460 is connected to magnetron 440 so as to apply the high-voltage to magnetron 440.

A cooking tray 480, on which the foodstuffs to be heated are placed, is provided in cooking cavity 410. In order to uniformly heat the foodstuffs, cooking tray 480 is coupled to a shaft 472 of a motor 470, and is rotated while the foodstuffs are being heated.

Microwave oven 400 having the above described structure operates as follows.

Firstly, when a user turns on an operating switch (not shown) attached to a front of cabinet 430, a microcomputer (not shown) installed in microwave oven 400 sends an operating signal to transformer 460. As a result, transformer 460 generates the high voltage and transfers the high voltage to magnetron 440 so that the high frequency microwaves are generated by magnetron 440. The high frequency microwaves are radiated into cooking cavity 410 through antenna 442, wave guide 450, and aperture 452 so the foodstuffs placed on cooking tray 480 are heated.

At the same time, the microcomputer sends an operating signal to motor 470 so as to rotate cooking tray 480 while the foodstuffs are being heated.

However, conventional microwave oven 400 having the above mentioned structure has a disadvantage in that the microwaves are not uniformly distributed in cooking cavity 410, so the microwaves penetrate into the foodstuffs to be heated to a limited depth. For this reason, when a large amount of the foodstuffs are placed on cooking tray 480, the microwaves do not reach a portion of the foodstuffs, so the foodstuffs are not uniformly heated.

In order to solve the above problem, a microwave oven which has a means for stirring the foodstuffs contained in a receptacle, thereby causing all of the foodstuffs to be subjected to the microwaves, has been proposed.

However, the microwave oven requires a sufficient stirring of the foodstuffs in order to uniformly heat the foodstuffs. Moreover, such stirring is difficult when the foodstuffs to be heated are fragile.

On the other hand, U.S. Pat. No. 4,937,418 issued to Boulard discloses a microwave oven which distributes the temperature inside the cooking cavity uniformly while minimizing the stirring of the foodstuffs.

Boulard's microwave oven has a wave spreader including a wave guide. The wave guide has at least one wave-receiving opening formed at an upper portion thereof and at least one wave-diffusing opening formed at a lower portion thereof. First and second deflectors for deflecting microwaves are provided in the wave guide.

However, Boulard's wave spreader is provided as a separate device and installed in the cooking cavity, so the useable volume of the cooking cavity is reduced.

In addition, U.S. Pat. No. 5,698,128 issued to Sakai discloses a microwave oven in which projections are formed in the cooking cavity. In the Sakai's microwave oven, a plurality of convex projections of different sizes are formed in the cooking cavity so as to uniformly distribute the microwaves radiated into the cooking cavity. But, forming the projections in the cooking cavity is difficult and the microwaves are not properly distributed in the cooking cavity if the convex projections are insufficiently provided in the cooking cavity.

SUMMARY OF THE INVENTION

The present invention has been made to solve the problems of the prior arts, and accordingly, it is an object of the present invention to provide a microwave oven which can uniformly distribute microwaves in horizontal and vertical directions within a cooking cavity, and which can be easily manufactured with simple structure.

To accomplish the above object of the present invention, there is provided a microwave oven comprising a cabinet having a cooking cavity for receiving a foodstuffs to be heated and a control chamber separated from the cooking cavity by a partition; a door installed at a front of the cabinet for opening/closing the cooking cavity; a magnetron installed at the control chamber for generating a microwave; and a wave guide for guiding the microwave generated by the magnetron into the cooking cavity, wherein the cooking cavity is defined by an upper wall, a bottom wall, a first side wall to which the wave guide is attached, a second side wall positioned opposite to the first side wall, the door, and a third side wall positioned opposite to the door, the first side wall being formed with a microwave outlet, the second and third side walls being formed with at least one concave portion for distributing the microwave.

According to a preferred embodiment of the present invention, the second and third side walls are formed with two arcuate concave portions, respectively, which are spaced by a predetermined distance apart from each other. Each concave portion has a diameter larger than a half wavelength of the microwave. A distance between a center of the arcuate concave portion formed at the second side wall and the bottom wall is larger than a half wavelength of the microwave. Each concave portion has a depth in a range of 3 to 24 mm.

When viewed from the top, a center between two arcuate concave portions formed at the second side wall is in line with or is offset by a predetermined distance from a center of the microwave outlet.

BRIEF DESCRIPTION OF THE DRAWINGS

The above object and other advantages of the present invention will become more apparent by describing in detail a preferred embodiment thereof with reference to the attached drawings, in which.

DETAILED DESCRIPTION OF THE INVENTION

Hereinafter, the present invention will be described in detail with reference to the accompanying drawings.

Figure 1:
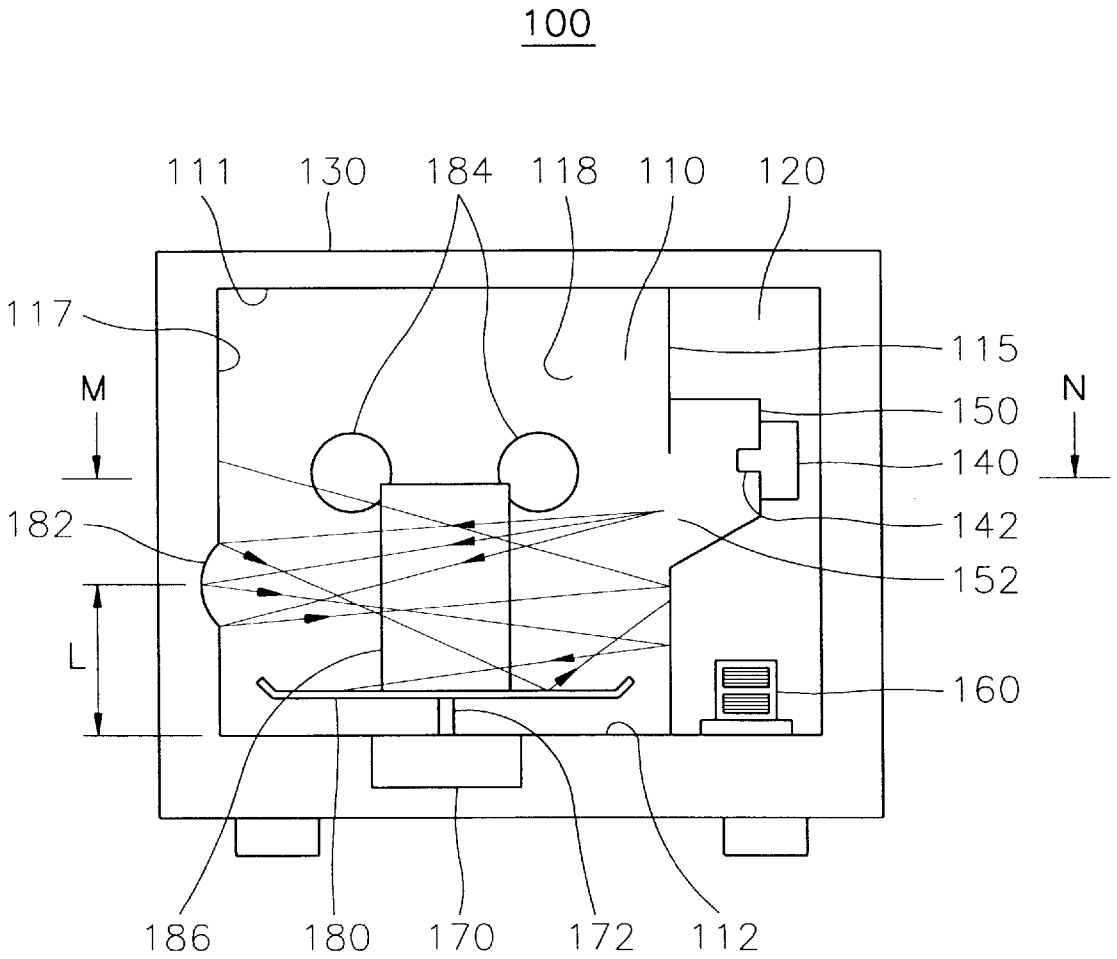
FIG. 1 is a cross-sectional view of a microwave oven according to a preferred embodiment of the present invention.

FIG. 1 shows a microwave oven 100 according to the preferred embodiment of the present invention.

As shown in FIG. 1, microwave oven 100 has a cabinet 130. Cabinet 130 includes a cooking cavity 110 and a control chamber 120 which are separated from each other by a first side wall 115. Cooking cavity 110 is defined by an upper wall 111, a bottom wall 112, a door 116 (shown in FIG. 2) installed at a front of microwave oven 100, a first side wall 115, a second side wall 117 positioned opposite to first side wall 115, and a third side wall 118 positioned opposite to door 116.

A wave guide 150 which guides a microwave generated from a magnetron 140 into cooking cavity 110 is attached to a rear side of first side wall 115. First side wall 115 is formed at its predetermined position corresponding to wave guide 150 with a microwave outlet 152 so as to allow the microwave to be radiated into cooking cavity 110. Magnetron 140 is assembled to one side of wave guide 150. An antenna 142 for transmitting the microwave to wave guide 150 is integrally formed with magnetron 140.

A transformer 160 for generating a high-voltage is mounted on a bottom wall of control chamber 120. Transformer 160 is connected to magnetron 140 so as to apply the high-voltage to magnetron 140.

A cooking tray 180, on which foodstuffs 186 to be heated are placed, is provided in cooking cavity 110. In order to uniformly heat the foodstuffs, cooking tray 180 is connected to a motor 170 through a shaft 172 and rotates while the foodstuffs are being heated.

In order to uniformly distribute the microwave radiated into cooking cavity 110 in horizontal and vertical directions thereof, second side wall 117 is formed with at least one first arcuate concave portion 182 and third side wall 118 is formed with at least one second arcuate concave portion 184. According to the preferred embodiment of the present invention, second and third side walls 117 and 118 are formed with two arcuate concave portions, respectively, which are spaced apart from each other by a predetermined distance. Also, according to another embodiment of the present invention, the upper wall is formed with at least one arcuate concave portion.

If two arcuate concave portions are formed at second side wall 117, a distance between two arcuate concave portions is formed in the range of a quarter wavelength to a half wavelength of the microwave.

Preferably, each arcuate concave portion has a diameter D larger than a half wavelength of the microwave. More preferably, the diameter of the arcuate concave portion is in the range of 70 to 100 mm. Within this range, first and second arcuate concave portions 182 and 184 can have different diameters from each other.

A distance L between a center C of each arcuate concave portion 182 formed at second side wall 117 and the bottom wall is larger than a half wavelength of the microwave. According to the preferred embodiment of the present invention, distance L is larger than 60 mm. Also, a depth d of the arcuate concave portion is in a range of 3 to 24 mm. Within this range, first and second arcuate concave portions can have different depths from each other.

When viewed from the top, a center C between two arcuate concave portions 182 formed at second side wall 117 is in line with or is offset by a predetermined distance from a center of microwave outlet 152. If center C between two arcuate concave portions 182 is offset from the center of microwave outlet 152, an offset distance l is shorter than an eighth wavelength of the microwave. That is, when viewed from the top, center C between two arcuate concave portions 182 formed at second side wall 117 is offset less than 15 mm from the center of microwave outlet 152.

In addition, a distance between a lower end of microwave outlet 152 and bottom wall 112 of cavity 110 is larger than a half wavelength of the microwave.

Figure 9:
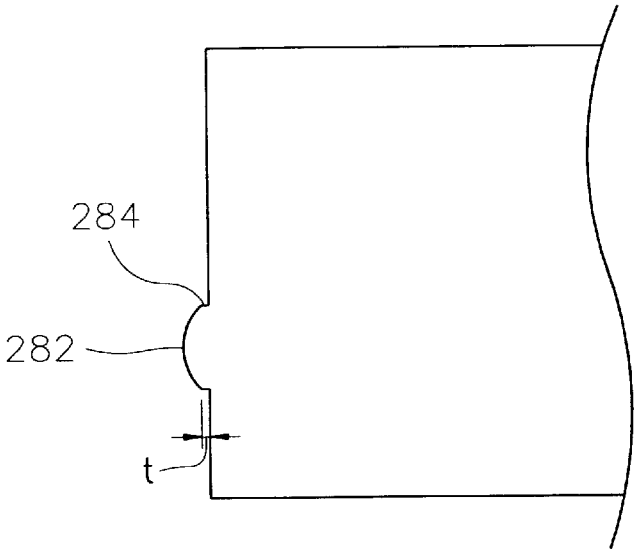
FIG. 9 is a cross-sectional view showing a concave portion for distributing microwaves according to a second embodiment of the present invention.

FIG. 9 shows an arcuate concave portion 282 according to another embodiment of the present invention. According to this embodiment, arcuate concave portion 282 is formed at a front edge thereof with a rim portion 284 having a diameter identical to the diameter of arcuate concave portion 282. In this case, forming arcuate concave portion 282 at a side wall of cooking cavity 110 is easily attained. Preferably, a width t of rim portion 284 is larger than 1 mm.

Figure 10:
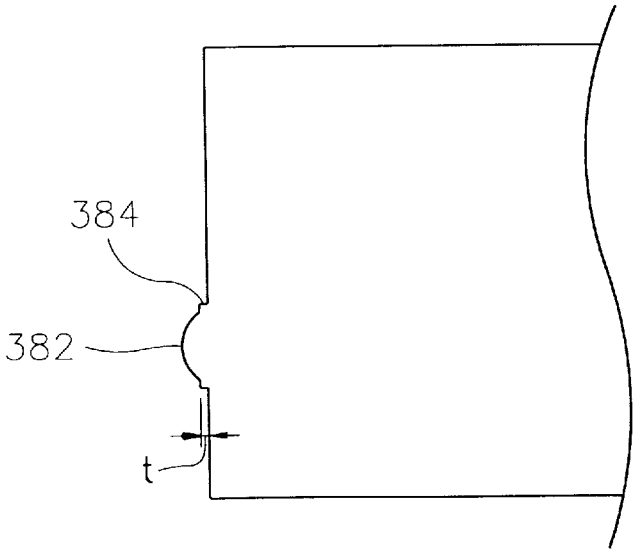
FIG. 10 is a cross-sectional view showing a concave portion for distributing microwaves according to a third embodiment of the present invention.
Figure 11:
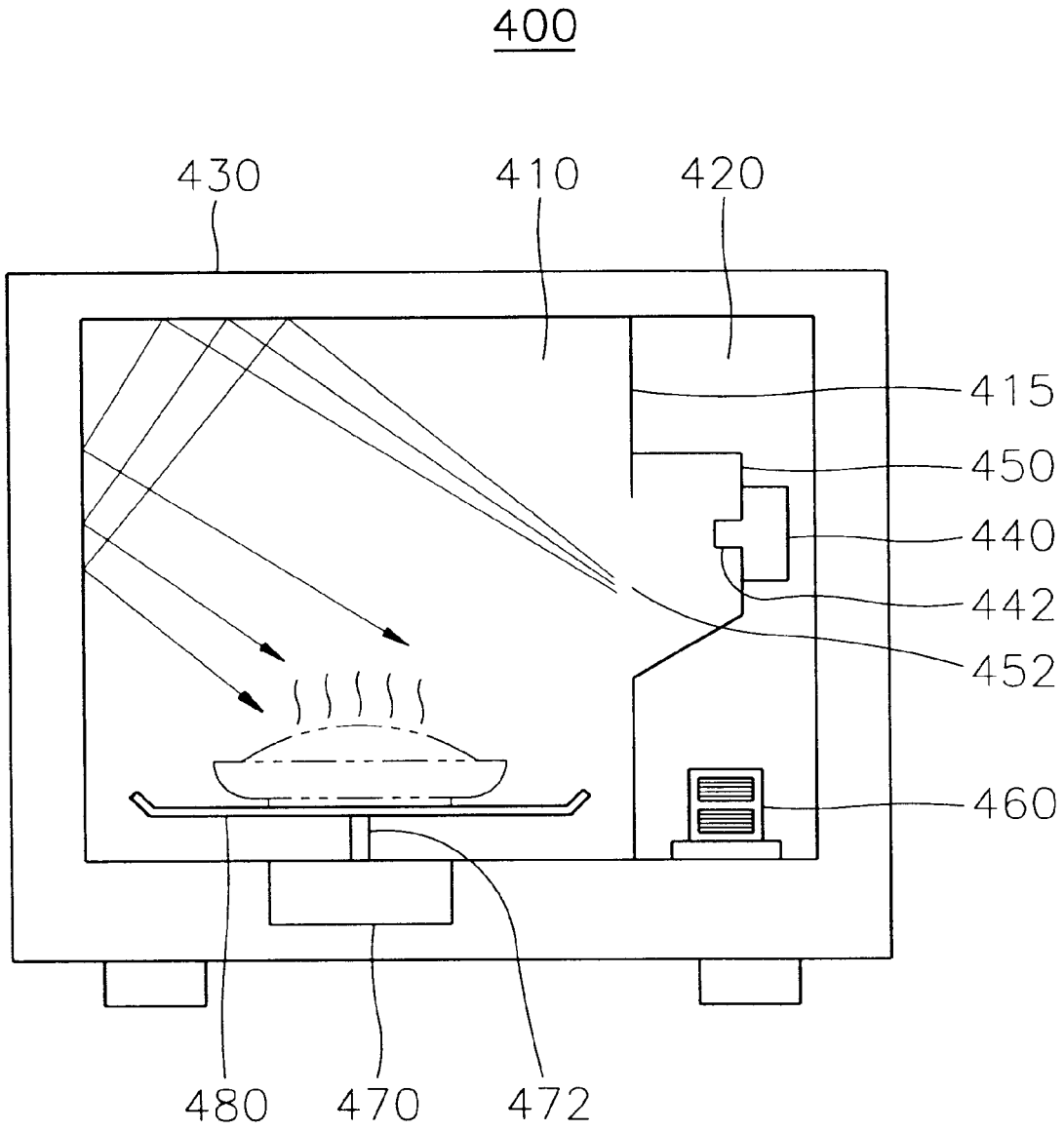
FIG. 11 (PRIOR ART)
FIG. 11 is a cross-sectional view of a conventional microwave oven.

FIG. 10 shows an arcuate concave portion 382 according to still another embodiment of the present invention. Arcuate concave portion 382 is formed at a front edge thereof with a rim portion 384 having a diameter larger than the diameter of arcuate concave portion 382. In this case, a radius of rim portion 384 is larger than the diameter of arcuate concave portion 382 by approximately 1 mm and a width t thereof is larger than 1 mm.

Microwave oven 100 having the above mentioned structure operates as follows.

Firstly, when the user turns on an operating switch (not shown) attached to a front portion of cabinet 130, a microcomputer (not shown) installed in microwave oven 100 sends an operating signal to transformer 160. Upon receiving the operating signal, transformer 160 generates a high voltage and transmits the high voltage to magnetron 140 so that the high-frequency microwaves are generated by magnetron 140. The high-frequency microwaves are radiated into cooking cavity 110 through antenna 142, wave guide 150 and microwave outlet 152.

Figure 2:
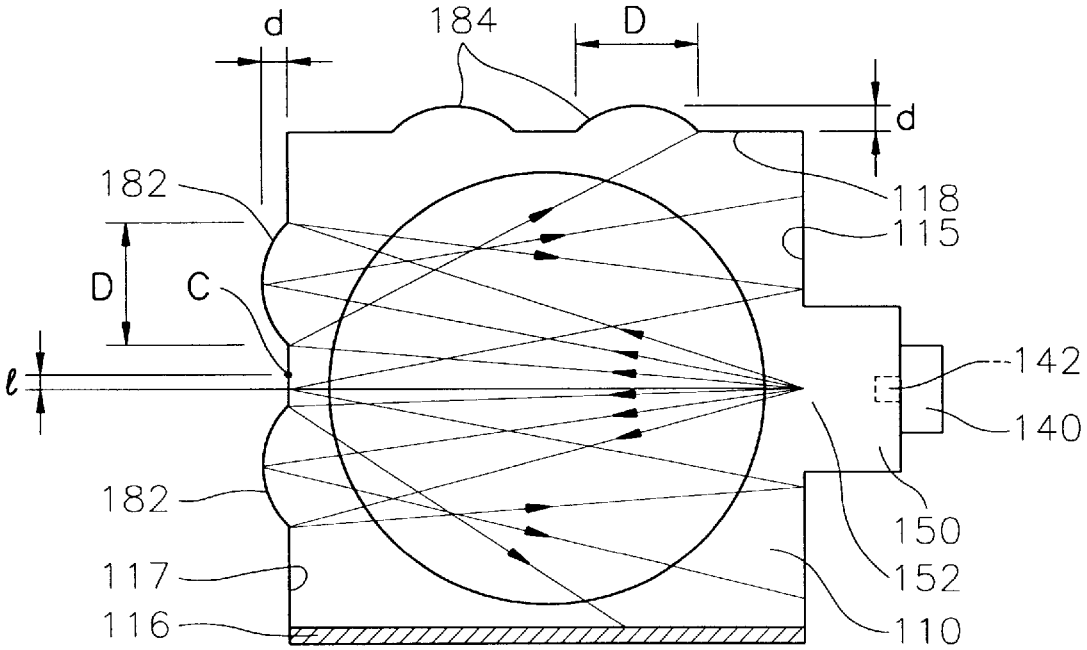
FIG. 2 is a sectional view taken along line M-N shown in FIG. 1.

As shown in FIGS. 1 and 2 in detail, when the microwaves radiated into cooking cavity 110 make contact with arcuate concave portions 182 and 184 formed at second and third side walls 117 and 118, the microwaves are deflected in various directions so as to penetrate vertically and horizontally through the foodstuffs 186 placed on cooking tray 180, thereby effectively heating foodstuffs 186.

In order to allow the microwaves to uniformly penetrate foodstuffs 186 in vertical and horizontal directions, not only must the deflected microwaves be properly guided into foodstuffs 186, but also hot spots, which are created when the deflected microwaves cross the radiated microwaves, must be uniformly created in the vertical and horizontal directions.

For that purpose, positions, shapes and sizes of arcuate concave portions 182 and 184 must be properly determined. The inventor of the present invention has carried out several geometrical experiments for creating optimal hot spots in cooking cavity 110 and found optimal positions, shapes and sizes of arcuate concave portions 182 and 184. According to the inventor's experiments, the microwaves are uniformly distributed in vertical and horizontal directions in cooking cavity 110 by forming arcuate concave portions 182 and 184 having positions, shapes and sizes as mentioned above.

Figure 3:
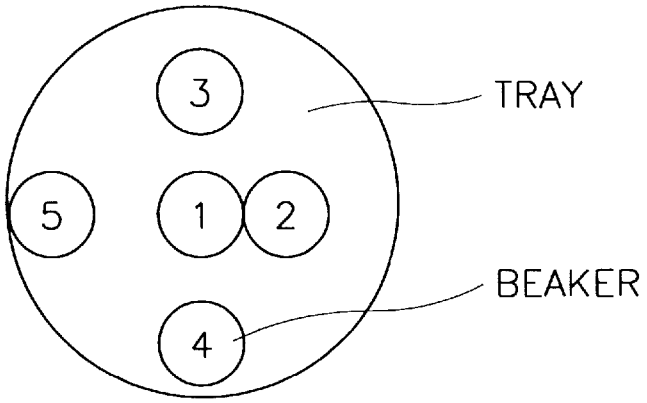
FIG. 3 is a plan view showing samples arranged for testing a temperature deviation in a horizontal direction.

The experimental results are as follows. To estimate deviations of horizontal temperature distribution in the cooking cavity, test samples 1 to 5 were arranged on the cooking tray as shown in FIG. 3. Beakers having water therein were used as test samples. Tables 1 and 2 show the results tested by a conventional microwave oven and the microwave oven of the present invention, respectively.

TABLE 1

Result tested by the conventional microwave oven.

| Temp.\Samples | 1 | 2 | 3 | 4 | 5 |
|---|---|---|---|---|---|
| T1 | 17.9 | 18.2 | 18.3 | 18.2 | 18.2 |
| T2 | 54.1 | 56.8 | 58.8 | 63.6 | 60.8 |
| ΔT | 36.2 | 38.6 | 40.5 | 45.4 | 42.6 |
| ΔTmax − ΔTmin | | | 9.2 | | |

(wherein, T1: temperature before heating, T2: temperature after heating, ΔT: T2 − T1, ΔTmax: maximum ΔT, ΔTmin: minimum ΔT, heating time: 2 minutes)

TABLE 2

Result tested by the microwave oven of the present invention.

| Temp.\Samples | 1 | 2 | 3 | 4 | 5 |
|---|---|---|---|---|---|
| T1 | 16.7 | 16.8 | 16.9 | 16.9 | 16.7 |
| T2 | 57.2 | 55.5 | 60.1 | 60.1 | 56.0 |
| ΔT | 40.5 | 38.7 | 43.2 | 43.2 | 39.3 |
| ΔTmax − ΔTmin | | | 4.5 | | |

(wherein, T1: temperature before heating, T2: temperature after heating, ΔT: T2 − T1, ΔTmax: maximum ΔT, ΔTmin: minimum ΔT, heating time: 2 minutes)

Figure 4:
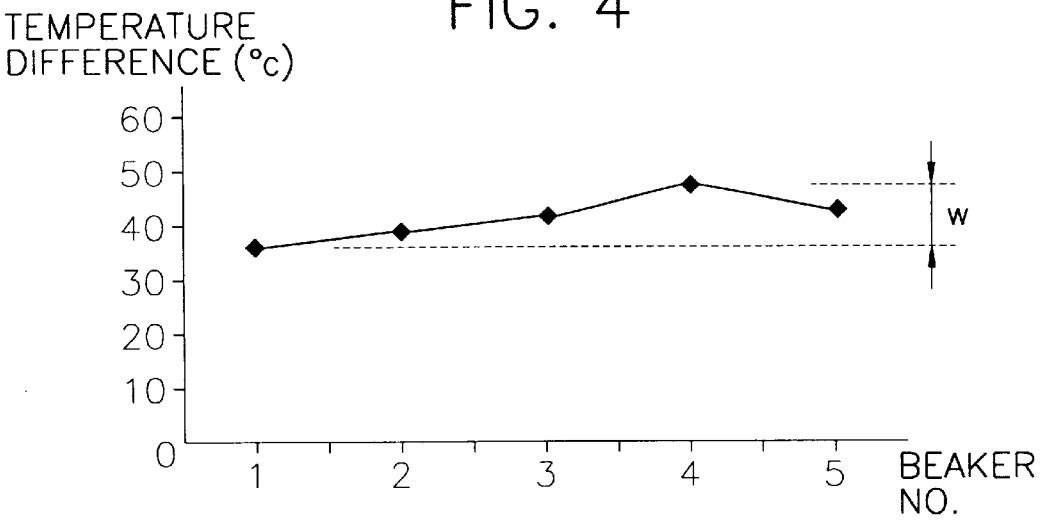
FIG. 4 is a graph showing a horizontal temperature deviation of the samples tested by a conventional microwave oven.
Figure 5:
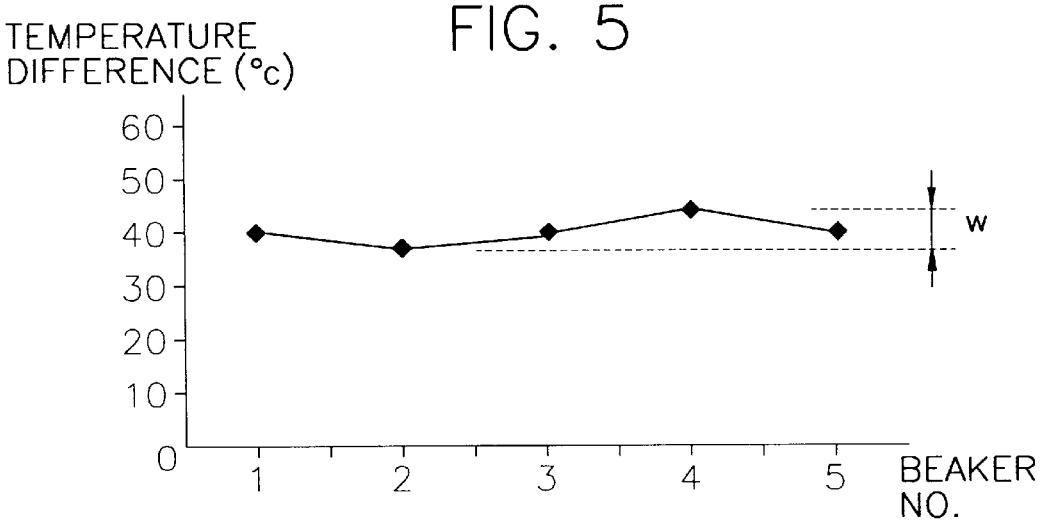
FIG. 5 is a graph showing a horizontal temperature deviation of the samples tested by a microwave oven of the present invention.

FIGS. 4 and 5 are graphs showing the above results. As is understood from FIGS. 4 and 5, in the conventional microwave oven, a temperature difference w between a sample 1 having minimum ΔT and a sample 4 having maximum ΔT was 9.2°. On the other hand, in the microwave oven of the present invention, the temperature difference w between a sample 2 having minimum ΔT and a sample 4 having maximum ΔT was 4.5°. Accordingly, it is understood that the microwave oven of the present invention can uniformly heat the foodstuffs horizontally.

Figure 6:
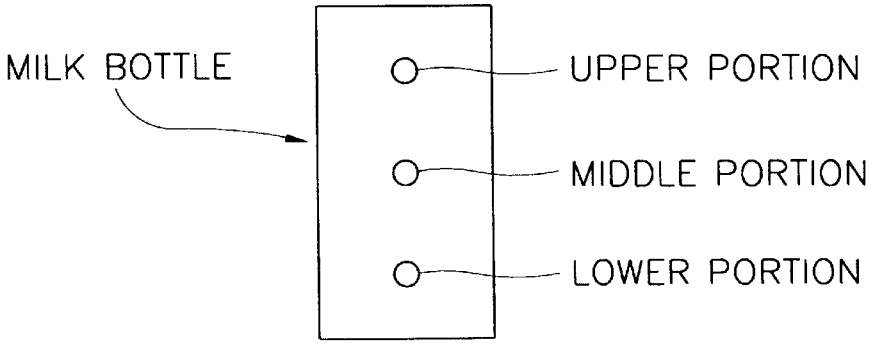
FIG. 6 is a front view showing a sample for testing a temperature deviation in a vertical direction thereof.

In addition, in order to test vertical temperature deviations in the cooking cavity, a bottle having a milk therein, as shown in FIG. 6, was used as a test sample. Tables 3 and 4 show the results tested by a conventional microwave oven and the microwave oven of the present invention, respectively.

TABLE 3

Result tested by the conventional microwave oven.

| Position\time (sec) | 0 | 20 | 40 | 60 | 80 | 100 | 120 | 140 | 160 | 180 |
|---|---|---|---|---|---|---|---|---|---|---|
| upper | 19.1 | 22.9 | 27.9 | 31.9 | 35.7 | 39.4 | 42.3 | 45.6 | 46.9 | 49.3 |
| middle | 19.0 | 24.7 | 30.0 | 34.5 | 39.7 | 44.2 | 48.7 | 51.8 | 54.1 | 57.7 |
| lower | 19.2 | 28.9 | 37.5 | 45.3 | 54.4 | 61.2 | 70.9 | 78.4 | 85.8 | 93.6 |

TABLE 4

| Result tested by the microwave oven of the present invention. | | | | | | | | | | |
|---|---|---|---|---|---|---|---|---|---|---|
| Position\time (sec) | 0 | 20 | 40 | 60 | 80 | 100 | 120 | 140 | 160 | 180 |
| upper | 16.4 | 20.5 | 24.2 | 28.3 | 32.3 | 35.7 | 38.2 | 40.7 | 43.5 | 44.4 |
| center | 17.0 | 24.0 | 30.8 | 37.3 | 43.5 | 48.5 | 51.9 | 55.6 | 59.4 | 62.4 |
| lower | 17.4 | 26.9 | 34.7 | 42.6 | 50.9 | 58.2 | 64.5 | 73.2 | 81.7 | 89.7 |

Figure 7:
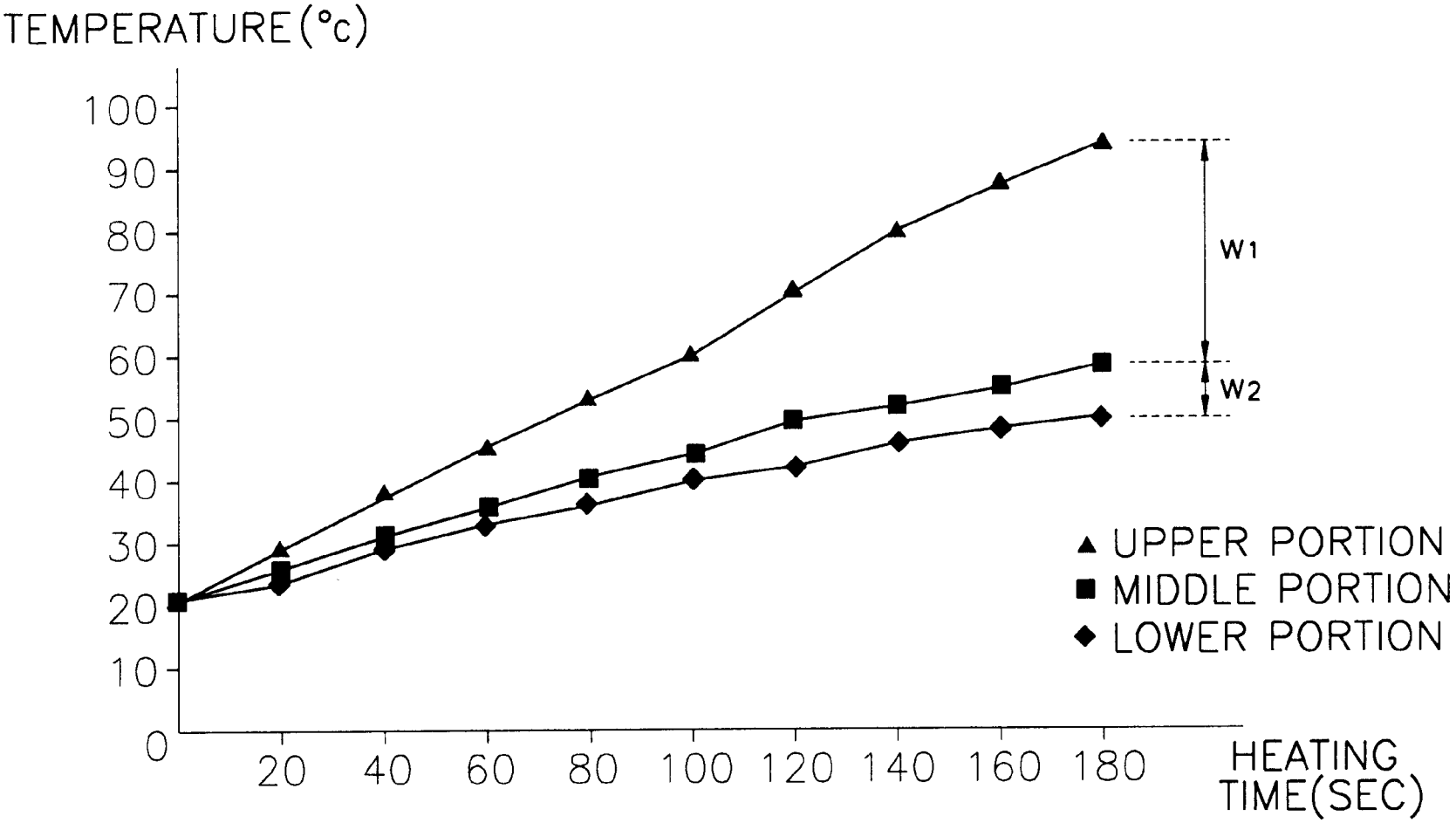
FIG. 7 is a graph showing a vertical temperature distribution of the sample tested by a conventional microwave oven.
Figure 8:
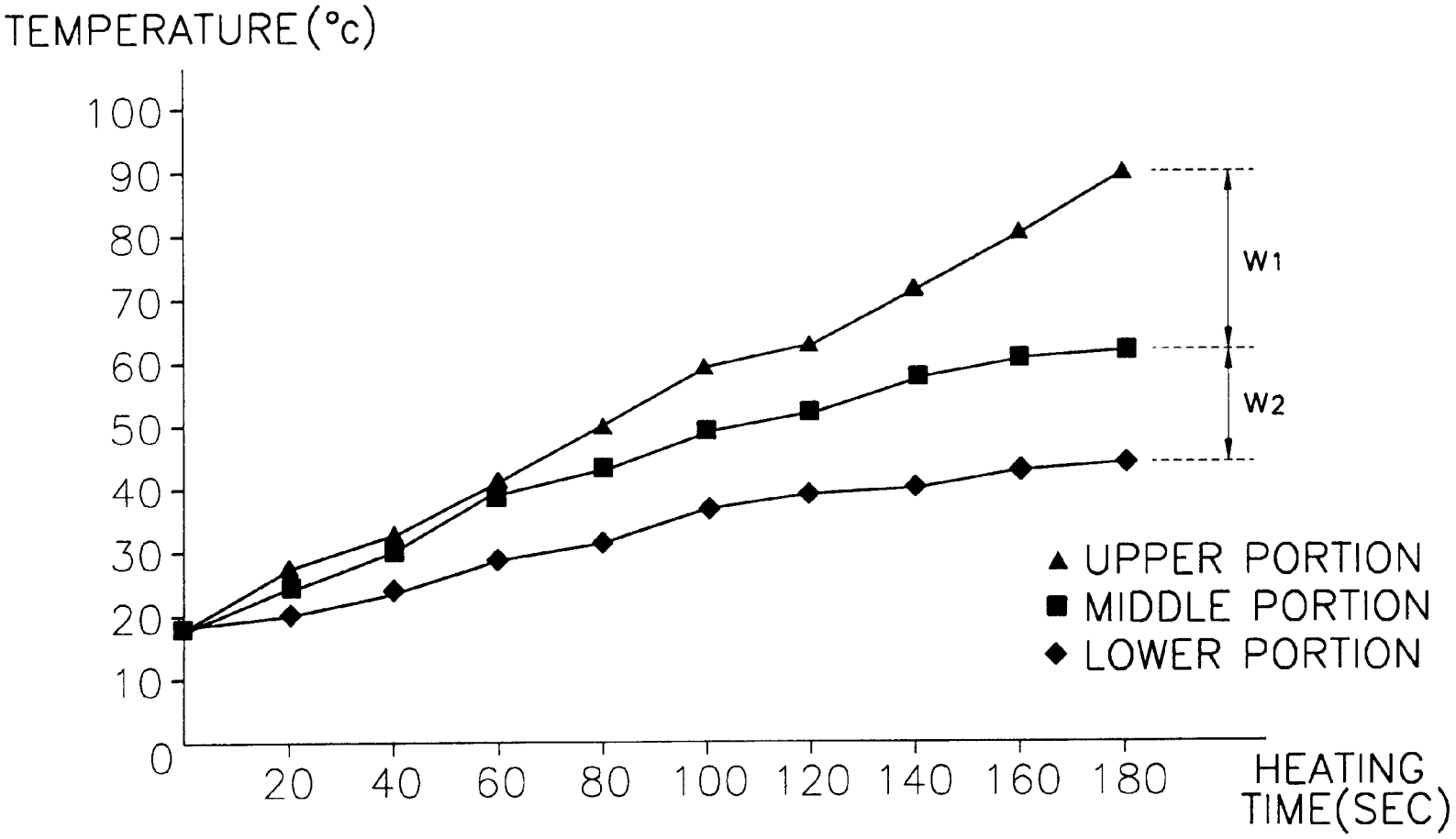
FIG. 8 is a graph showing a vertical temperature distribution of the sample tested by a microwave oven of the present invention.

FIGS. 7 and 8 are graphs showing the above results. In the conventional microwave oven, a temperature difference $w_1$ between upper and middle portions of the milk bottle was larger than a temperature difference $w_2$ between middle and lower portions of the milk bottle. In contrast, in the microwave oven of the present invention, temperature difference $w_1$ between upper and middle portions of the milk bottle is similar to temperature difference $w_2$ between middle and lower portions of the milk bottle. Accordingly, it is understood that the microwave oven of the present invention can uniformly heat the foodstuffs vertically.

The above results have been obtained through many experiments and water, pizza, milk and the like were used as samples. As a result, the foodstuffs are uniformly and effectively heated and taste good.

As described above, the microwave oven according to the present invention can uniformly penetrate the microwaves through the foodstuffs in vertical and horizontal directions thereof so that the heating efficiency to the foodstuffs is improved and the heating time thereof is reduced.

Further, since the arcuate concave portions have simple shapes, manufacturing work thereof is easy and the manufacturing cost thereof is reduced.

Although the preferred embodiment of the invention has been described, it will be understood by those skilled in the art that the present invention should not be limited to the described preferred embodiment, but various changes and modifications can be made within the spirit and scope of the invention as defined by the appended claims.

What is claimed is:

1. A microwave oven comprising:

a cabinet having a cooking cavity for receiving foodstuffs to be heated and a control chamber separated from the cooking cavity by a partition;

a door installed at a front of the cabinet for opening/closing the cooking cavity;

a magnetron installed at the control chamber for generating a microwave; and a wave guide for guiding the microwave generated by the magnetron into the cooking cavity, wherein the cooking cavity is defined by an upper wall, a bottom wall, a first side wall at which the wave guide is attached, a second side wall positioned opposite to the first side wall, the door, and a third side wall positioned opposite to the door, the first side wall being formed with a microwave outlet, the second and third side walls each being formed with two arcuate concave portions for distributing the microwave, the arcuate concave portions being spaced apart from each other by a predetermined distance, each arcuate concave portion having a diameter greater than a half wavelength of the microwave, a distance between a center of each arcuate concave portion formed at the second side wall and the bottom wall being greater than a half wavelength of the microwave.

2. The microwave oven as claimed in claim 1, wherein a diameter of each concave porion is in a range of 30 to 100 mm.

3. The microwave oven as claimed in claim 1, wherein a distance between a center of each arcuate concave portion formed at the second side wall and the bottom wall is larger than 60 mm.

4. The microwave oven as claimed in claim 1, wherein each arcuate concave portion has a depth in a range of 3 to 24 mm.

5. The microwave oven as claimed in claim 1, wherein, when viewed from a top, a first center between two arcuate concave portions formed at the second side wall is in line with a second center of the microwave outlet.

6. The microwave oven as claimed in claim 1, wherein when viewed from a top, a first center between two arcuate concave portions formed at the second side wall is offset from a second center of the microwave outlet less than an eighth wavelength of the microwave.

7. The microwave oven as claimed in claim 1, wherein when viewed from a top, a first center between two arcuate concave portions formed at the second side wall is offset from a second center of the microwave outlet by less than 15 mm.

8. The microwave oven as claimed in claim 1, wherein a rim portion having a depth larger than 1 mm is formed at a front edge of each arcuate concave portion.

9. The microwave oven as claimed in claim 1, wherein a distance between two arcuate concave portions formed at the second side wall is in a range of a quarter wavelength to a half wavelength of the microwave.

10. The microwave oven as claimed in claim 1, wherein a distance between a lower end of the microwave outlet and the bottom wall of the cavity is larger than a half wavelength of the microwave.

11. The microwave oven as claimed in claim 1, wherein each arcuate concave portion has a diameter larger than a half wavelength of the microwave, a distance between a first center of each arcuate concave portion formed at the second side wall and the bottom wall is larger than a half wavelength of the microwave, each arcuate concave portion has a depth in a range of 3 to 24 mm, and when viewed from a top, a second center between two arcuate concave portions formed at the second side wall is in line with a third center of the microwave outlet.

12. The microwave oven as claimed in claim 1, wherein a diameter of each concave porion is in a range of 30 to 100 mm, a first distance between a first center of each arcuate concave portion formed at the second side wall and the bottom wall is larger than 60 mm, each arcuate concave portion has a depth in a range of 3 to 24 mm, and, when viewed from a top, a second center between two arcuate concave portions formed at the second side wall is offset from a third center of the microwave outlet by less than 15 mm.

13. The microwave oven as claimed in claim 12, wherein a second distance between two arcuate concave portions formed at the second side wall is in a range of a quarter wavelength to a half wavelength of the microwave, and a third distance between a lower end of the microwave outlet and the bottom wall of the cavity larger than a half wavelength of the microwave.

14. A microwave oven comprising:

a cabinet having a cooking cavity for receiving foodstuffs to be heated and a control chamber separated from the cooking cavity by a partition;

a door installed at a front of the cabinet for opening/closing the cooking cavity;

a magnetron installed at the control chamber for generating a microwave; and a wave guide for guiding the microwave generated by the magnetron into the cooking cavity, wherein the cooking cavity is defined by an upper wall, a bottom wall, a first side wall at which the wave guide is attached, a second side wall positioned opposite to the first side wall, the door, and a third side wall positioned opposite to the door, the first side wall being formed with a microwave outlet, the second and third side walls each being formed with two arcuate concave portions for distributing the microwave, the arcuate concave portions being spaced apart from each other by a predetermined distance, each arcuate concave portion having a diameter larger than a half wavelength of the microwave, a distance between a center of each arcuate concave portion formed at the second side wall and the bottom wall being larger than a half wavelength of the microwave, each arcuate concave portion having a depth in a range of 3 to 24 mm, a center between two arcuate concave portions formed at the second side wall being in line with a center of the microwave outlet when viewed from a top, a rim portion having a depth larger than 1 mm being formed at a front edge of each arcuate concave portion, a distance between two arcuate concave portions formed at the second side wall being in a range of a quarter wavelength to a half wavelength of the microwave, a distance between a lower end of the microwave outlet and the bottom wall of the cavity being larger than a half wavelength of the microwave.

* * * * *